United States Patent [19]

Barnhardt et al.

[11] 4,179,762

[45] Dec. 25, 1979

[54] TRAP AND SOLIDS REMOVAL ASSEMBLY FOR DRAINS

[76] Inventors: Kenneth O. Barnhardt, 3348 Harvard, Santa Ana, Calif. 92704; Lawrence H. Morita, 20212 Big Bend La., Huntington Beach, Calif. 92646

[21] Appl. No.: 936,368

[22] Filed: Aug. 24, 1978

[51] Int. Cl.[2] ..... E03C 1/282

[52] U.S. Cl. ..... 4/191; 4/206; 4/207; 4/DIG. 14; 137/247.51

[58] Field of Search ..... 4/207, 197, 206, 292, 4/286, DIG. 14, 191; 137/247.51, 247.41; 210/447

[56] References Cited

U.S. PATENT DOCUMENTS

| | | | |
|---|---|---|---|
| 1,217,763 | 2/1917 | Hirrich | 4/DIG. 14 |
| 1,817,376 | 8/1931 | Izquierdo | 4/DIG. 14 |
| 2,971,650 | 2/1961 | Miranda | 210/447 |
| 4,032,455 | 6/1977 | Kale | 137/247.51 |

*Primary Examiner*—Lenard A. Footland
*Attorney, Agent, or Firm*—Elgin C. Edwards

[57] ABSTRACT

A U-shaped drain trap is described having a modified cylindrical base portion to provide for visual inspection and cleaning. The base portion is adapted for use with a unitary filtering and sealing device which is inserted within, and closes, one end of the cylindrical base.

9 Claims, 2 Drawing Figures

FIG. 1.
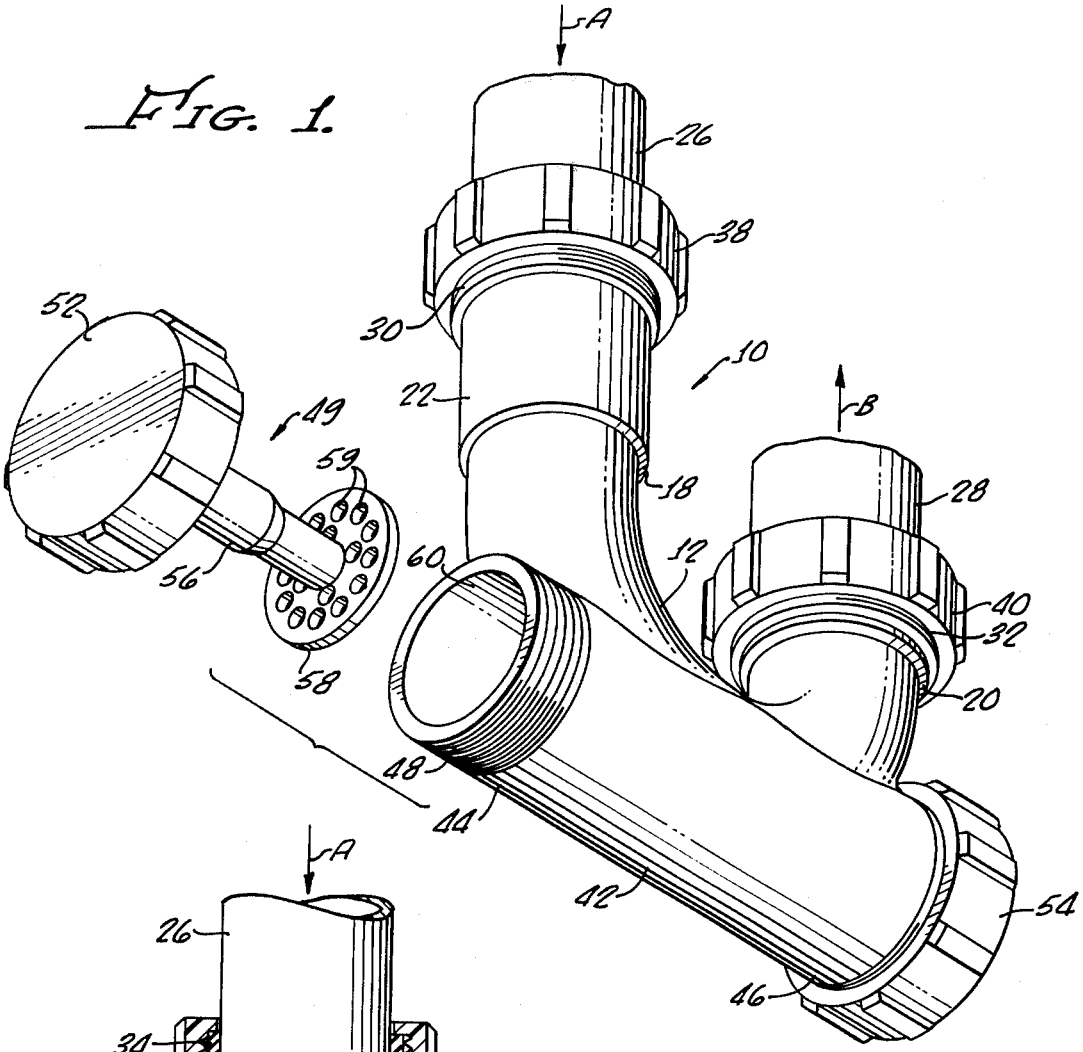
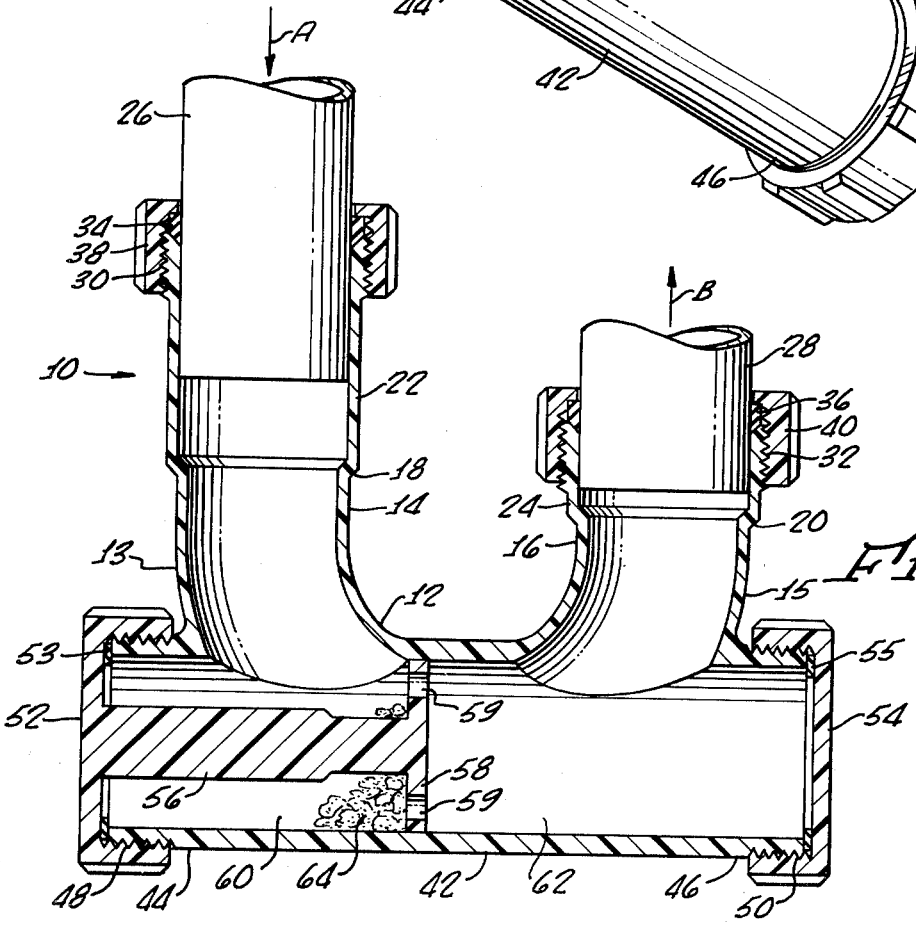
FIG. 2.

TRAP AND SOLIDS REMOVAL ASSEMBLY FOR DRAINS

BACKGROUND OF THE INVENTION

This invention relates to traps in plumbing drainage systems. More particularly, it relates to traps which are adapted for cleaning without their removal from the plumbing lines.

Traps have been used for many years on pipes used to drain sinks, baths, and other plumbing facilities. Typically, a trap includes a U-shaped section designed to retain water in its arcuate base to prevent noxious odors and gases, and the like, from backing up from downstream facilities (such as sewer lines) into the sinks or other plumbing facilities. While such traps have been highly effective for that purpose, they suffer from one major disadvantage, namely, a tendency to collect solid sediment in the bottom of the U-shaped section. When excessive sediment is collected, the drain line clogs, and drainage fluids may be partially or totally prevented from draining out of the plumbing facilities. A plumber's services thus are often required under urgent circumstances and correction often requires the complete removal of the trap. However, when the trap is removed, the water standing in the sink or other facility above it may immediately commence to drain, and the plumber is faced with the task of handling the trap and simultaneously controlling the drainage. The plumber must also drain the liquids remaining in the U-shaped section, then clean out the solid sediment, and re-connect the trap back to the plumbing system. Because of its shape, visual inspection of the interior of the U-shaped section is not practical and only by re-installing it and testing it can the plumber be assured that the fixture has been adequately cleaned.

Many attempts have been made over the years to design a trap which could be cleaned without removing it from the plumbing lines. However, all such attempts at improving the trap design have been accompanied by problems.

Many prior art devices require a trial and error cleaning operation, for example, by inserting a snake or other type of cleaning probe into the trap and attempting to entangle the blockage materials about the snake so that they can be withdrawn. This can be a tedious process and may not satisfactorily clean the traps in any event. In many prior art cleaning techniques, it is impossible to visually inspect the interior of the trap to determine whether it has been adequately cleaned. Some devices in the prior art depend upon a cleaning technique which drives clogging materials further down into the drain line rather than withdrawing it from the trap. Not only may such techniques simply aggravate the problem, but they also do not permit the recovery of valuables or other materials which inadvertently fall into sinks and pass into drainage systems.

Some prior art devices designed for the cleaning of traps without removing them are extremely complicated and expensive to install. For example, it has been suggested to devise a mechanism for injecting hot water at a high pressure into the trap to force the contents downstream. Others insert devices into the bottom of the trap to catch sediment flowing downstream. However, such devices are often quick to clog and difficult to clean. Some have a non-uniform filtering capability which may permit some solid particles to pass through while stopping other identically sized particles. Further, one cannot be sure that in removing their filters all of the solid material in the trap has been withdrawn.

Because of these and other problems, the vast majority of traps now being used continue to be of the type which requires complete removal from the plumbing lines for cleaning.

It is an object of the present invention to provide a trap and cleaning system which can be used to greatly alleviate or even eliminate these and other problems in the prior art.

SUMMARY OF THE INVENTION

In accordance with the present invention, a drain trap assembly is provided having a U-shaped base portion and cylindrical clean-out section which is integrally incorporated in the U-shaped base portion to provide for access from the exterior of the trap to the interior of the lowest portion of the trap. The cylindrical section may also include an opening positioned at each end to provide for drainage of the trap and insertion of cleaning devices, and for visual inspection of the interior of the base portion.

In one particularly preferred embodiment of the invention, a unitary sealing and filter means is provided for sealing the end of the cylindrical clean-out section and for positioning a filter in the lowest part of the base portion, the filter and seal being adapted for easy linear withdrawal from the clean-out section and providing for positive displacement and removal of any sediment or other solids collected adjacent the filter means.

BRIEF DESCRIPTION OF THE DRAWINGS

FIG. 1 is an exploded perspective view of a trap and cleaning assembly including a unitary seal and trap filter; and FIG. 2 shows the system of FIG. 1 in cross section with the filter and seal secured in position in the trap assembly.

DETAILED DESCRIPTION OF THE INVENTION

In a particularly preferred embodiment, there is shown in the drawings a trap assembly 10 having a generally arcuate, tubular, U-shaped base portion 12 integrally connected to upwardly extending legs 13 and 15. The upwardly extending legs include straight cylindrical sections 14 and 16 connected by integral flares 18 and 20 to cylindrical sections 22 and 24, which are enlarged sufficiently to accomodate the insertion of drain line 26 from a sink (or other facility to be drained) and outlet line 28 to a downstream disposal system or sewer.

The cylindrical sections 22 and 24 include threaded portions 30 and 32 which are adapted to receive gaskets or seals 34 and 36 and coupling nuts 38 and 40.

The arcuate base portion 12 includes a cylindrical portion 42 which connects, and is integrally formed with, upwardly extending legs 13 and 15, for fluid communication with each other. The axis of the cylindrical portion 42 lies in the same plane as the axes of base portion 12 and upwardly extending legs 13 and 15.

Cylindrical portion 42 extends outwardly beyond the upwardly extending legs 13 and 15 of trap assembly 10 to terminate in end portions 44 and 46, which are equipped with threaded sections 48 and 50. The threaded sections 48 and 50 are adapted to receive threaded sealing caps 52 and 54, which may be equipped with washers or gaskets 53 and 55 to perfect the seal of both end portions 44 and 46.

The unitary sealing and filtering means 49 (shown in FIG. 1) is comprised of a sealing cap 52 attached via connecting support 56 to filter disc 58. The filter disc 58 includes perforations 59, which are designed to permit the flow of fluids and small particulate matter while preventing the passage of large solids.

While any conventional plumbing grade of materials can be used to form the components of the trap assembly of this invention, it is particularly preferred to prepare them from thermoplastics, since many of these can be readily injection molded in a wide variety of standard dimensions, are lightweight and durable, and are less expensive than conventional metallic trap assemblies.

The installation and use of the trap assemblies of this invention can be performed by virtually anyone without any significant mechanical aptitude. Also, after an existing trap is removed, the trap assembly 10 can be installed entirely without special tools. The coupling nuts 38 and 40 are loosened, and the assembly is installed on a drain line 26 by inserting the line within cylindrical section 22. Similarly, the downstream outlet line 28 to, e.g., the sewage system, is inserted within cylindrical section 24. After the trap is in position on the drain line and outlet line, coupling nuts 38 and 40 are tightened on threaded portions 30 and 32 until gaskets or seals 34 and 36 have been compressed sufficiently to effect a leakproof seal. The installer then makes sure that threaded sealing caps 52 and 54 are tightened sufficiently securely to seal the ends of cylindrical portion 42 of the base portion 12 of the trap assembly, and then the assembly is ready for use.

When the trap assembly is in use, drainage liquids flow downwardly as shown by arrow "A" through drain line 26 into the trap assembly via inlet leg 13 and exit the trap assembly upwardly through outlet leg 15 and line 28 as shown by arrow "B".

If some valuable item is inadvertently dropped into the drain, of if the trap begins to plug due to the accumulation of solid matter, the assembly can be instantly and effectively opened to recover the valuables or to remove the plugging material. Thus, whatever solid materials enter through the drain line 26 will be collected in the inlet side cavity 60 if they are of a size greater than the size of the perforations 59 in filter disc 58. Smaller particles and fluids will pass through the perforations 59 into exit side cavity 62 of cylindrical portion 42 and be carried out through outlet line 28. Any solid particulate matter which is too large to pass through the perforations 59 of filter disc 58 will collect as an accumulation 64 until, ultimately, the passage of fluids through the filter disc 58 may be completely blocked.

To remove the accumulation 64, all that is required is to unscrew threaded sealing cap 52 from the threaded section 48 of end portion 44 and pull the cap axially away from end portion 44, thus simultaneously withdrawing sealing and filter means 49 and the accumulation 64 of sediment or other items out of the trap assembly. Preferably, the diameter of filter disc 58 should be just sufficiently smaller than the internal diameter of cylindrical portion 42 to permit the disc to slide inwardly and outwardly without binding, yet keeping the clearance between the disc and the cylinder walls sufficiently small to prevent any large particulate matter from bypassing the filter disc and to assure that the disc will positively displace and remove the entire accumulation when the disc is withdrawn.

After the unitary sealing and filtering means 49 is withdrawn from the cylindrical portion 42, the particulate matter or sediment 64 can be shaken loose or rinsed off, and means 49 can be immediately reinserted, so that the trap assembly can be quickly put back in operation. The only precaution to be taken is to place a container beneath the end portion 44 before unscrewing cap 52 so that any liquids in the trap assembly or lines 26 or 28 can be caught, if desired. Thus, the entire cleaning operation can be carried out and the system returned to operating condition in a matter of seconds.

One of the outstanding features of the embodiment shown in the drawings is that with the sealing cap 52 removed, it is possible to completely drain any liquids out of the bottom of arcuate base portion 12 and to visually examine the inside to make sure that all sediment has been removed. In the event that lighting conditions are especially bad, it is possible to improve the visual inspection by removing sealing cap 54 on end portion 46 of the cylindrical portion 42 to permit inspection or light entry from either end. Moreover, in the event that there should be some accumulation of plugging materials in the exit side cavity 62, it is easy to clean the entire cylindrical portion 42 by removing both sealing caps 52 and 54 and passing a cloth, or plunger, or other device, all the way through cylindrical portion 42 from end to end. Even when both caps 52 and 54 are removed, it is still possible to carry out the entire cleaning operation in a very short period of time.

The size of the perforations 59 in filter disc 58 can be varied depending upon the type of materials expected to be encountered by the filter. However, it is presently contemplated that in a filter disc 1½ inches in diameter in a conventional household type of drain trap, uniform perforations from about ⅛ to about ¼ inch in diameter are preferred. Smaller perforations may have a tendency to clog frequently and, on the other hand, when the perforations have too large diameters, an excessive amount of sediment may pass through the perforations and may eventually fill the exit side cavity 62, clogging that portion of the cylindrical portion 42 of the trap assembly. Uniformity of perforation sizes may be particularly useful in certain industrial applications where it is important to know in advance what sizes of particles can be expected to pass through, with the assurance that all larger ones will be retained in the trap.

While particularly preferred embodiments have been described in detail, it will be appreciated by those skilled in the art, that many variations can be used without departing from the spirit of the invention, and it is accordingly intended that the scope of the invention be limited only by the attached claims.

We claim:

1. An improved drain trap assembly for use on plumbing lines comprising:

a generally U-shaped tubular base portion having an inlet side and an outlet side, a cylindrical inlet leg integrally connected to the inlet side of said tubular base portion, a cylindrical outlet leg integrally connected to the outlet side of said tubular base portion, a cylindrical clean-out section, said clean-out section being integrally incorporated in said base portion and having its axis substantially in a common plane with the axis thereof, and sealing means for sealing each end of said cylindrical clean-out section, said sealing means at each of said ends being detachable for removal from said clean-out section to permit drainage and cleaning thereof.

2. A trap assembly as recited in claim 1 where the ends of said clean-out section extend longitudinally outwardly from the U-shaped base, beyond said inlet and outlet legs.

3. A drain trap assembly as recited in claim 2 further comprising a filter means adapted for positioning in said cylindrical clean-out section, said filter means being connected to the sealing means for the end of the clean-out section which extends beyond said inlet leg, and said filter means being adapted for simultaneous withdrawal from said clean-out section when said sealing means is removed therefrom.

4. A drain trap assembly as recited in claim 3 wherein said filter means comprises a flat disc having multiple perforations extending therethrough, said disc having a diameter sufficiently large for substantially filling the cross section of said clean-out section but sufficiently small to permit said disc to be moved axially within said clean-out section without binding therein.

5. A drain trap assembly as recited in claim 4 wherein said perforations are substantially uniform in size and range from about $\frac{1}{8}$ inch to about $\frac{1}{4}$ inch in diameter.

6. In a drain trap assembly of the type having a vertical inlet leg adapted for connection to a plumbing facility to be drained, a vertical outlet leg adapted for connection to an outlet line to a drainage disposal, and an arcuate section connecting said legs, the improvement comprising:

a cylindrical clean-out section integrally incorporated horizontally within said arcuate section, said cylindrical cleanout section having an axis lying substantially in a common plane with the axes of said vertical legs, said clean-out section extending from said arcuate section beyond said vertical inlet leg, means for sealing the end of said clean-out section extending beyond said inlet leg, filter means positioned in said clean-out section intermediate said inlet and outlet legs, said filter means being integrally connected to said sealing means, said sealing means and filter means being adapted for detachment and removal from said clean-out section, and wherein said inlet and outlet legs, arcuate section, and cylindrical clean-out section are comprised of injection molded thermoplastic.

7. A drain trap assembly as recited in claim 6 wherein said sealing means comprises a threaded cap and said clean-out section is compatibly threaded to engage said threaded cap.

8. An improved trap assembly of the type adapted for use on plumbing lines handling flowing liquids which contain solid particulate matter of the type having a tendency to accumulate in the trap and require periodic removal therefrom, comprising:

a generally U-shaped trap having a vertical leg on each of the inlet and outlet sides of the trap and a substantially horizontal cylindrical base interconnecting said legs, said cylindrical base extending outwardly beyond the interconnection of said base with said vertical leg on the inlet side of the trap;

a removable unitary sealing and filtering means including a sealing member adapted to seal the end of said cylindrical base which extends beyond said interconnection, a filtering member adapted to fit within said cylindrical base between said vertical legs, and a connecting member connecting said sealing member to said filtering member such that when said sealing member is removed from the trap said filtering member is simultaneously withdrawn outwardly therefrom, said filtering member being adapted to provide positive displacement and removal of any particulate matter which has accumulated between said filtering member and said sealing member when said unitary sealing and filtering means is removed from said cylindrical base, and wherein said cylindrical base also extends outwardly beyond the interconnection of said base with said vertical leg on the outlet side of said trap and wherein there is further included a removable sealing member adapted to seal the end of said cylindrical base which extends beyond the vertical leg on the outlet side of said trap.

9. A trap assembly as recited in claim 8 wherein said filtering member comprises a perforated disc having uniform perforations ranging in diameter from about $\frac{1}{8}$ inch to about $\frac{1}{4}$ inch.

* * * * *